US006991138B2

(12) United States Patent
Marroncles

(10) Patent No.: US 6,991,138 B2
(45) Date of Patent: Jan. 31, 2006

(54) SPRAY HEAD FOR A CONTAINER WITH A VALVE

(75) Inventor: Alain Marroncles, Saint Maur des Fossés (FR)

(73) Assignee: Lindal Ventil GmbH, Bad Oldesloe (DE)

( * ) Notice: Subject to any disclaimer, the term of this patent is extended or adjusted under 35 U.S.C. 154(b) by 0 days.

(21) Appl. No.: 10/898,531

(22) Filed: Jul. 23, 2004

(65) Prior Publication Data

US 2005/0230504 A1 Oct. 20, 2005

(30) Foreign Application Priority Data

Apr. 16, 2004 (EP) ..... 04009061

(51) Int. Cl.
*B65D 83/00* (2006.01)
*B05B 7/32* (2006.01)

(52) U.S. Cl. ..... 222/402.11; 202/402.13; 202/153.11; 202/153.13; 202/153.14; 239/137; 239/506; 239/581.1

(58) Field of Classification Search ..... 222/402.1, 222/402.11, 402.12, 402.13, 153.11, 153.13, 222/153.14, 562; 220/836, 840, 820; 239/337, 239/504, 505, 506, 507, 581.1
See application file for complete search history.

(56) References Cited

U.S. PATENT DOCUMENTS 3,116,856 A * 1/1964 Prussin et al. ..... 222/402.24
3,143,254 A * 8/1964 Vanderhyde ..... 222/402.11
3,739,950 A * 6/1973 Gorman ..... 222/182
3,752,370 A 8/1973 Davenport
4,442,955 A * 4/1984 Bush ..... 222/153.02
5,255,823 A * 10/1993 Tichy et al. ..... 222/153.14
5,392,961 A 2/1995 Starrett
5,624,055 A * 4/1997 Clanet et al. ..... 222/135
6,349,855 B1 * 2/2002 Borri ..... 222/182
6,405,898 B1 * 6/2002 O'Connor et al. ..... 222/108
6,796,464 B1 * 9/2004 Tung ..... 222/402.17

FOREIGN PATENT DOCUMENTS

| | | |
|---|---|---|
| DE | 44541 | 9/1987 |
| DE | 3342883 | 6/1995 |
| FR | 2832390 | 5/2003 |

OTHER PUBLICATIONS

Patent Abstract of Japan BD 1998, No. 11, for Appln No. 08314940 Nozzle for Spray Vessel.

* cited by examiner

*Primary Examiner*—David A. Scherbel
*Assistant Examiner*—Seth Barney
(74) *Attorney, Agent, or Firm*—Vidas, Arrett & Steinkraus, P.A.

(57) ABSTRACT

Cap for a container with a valve, with a container attachment which comprises an actuation surface, an extension pipe for receiving the valve and a discharge channel connected to the extension pipe, a cover element which—pivotally mounted relative to the container attachment—in a first position at least partially covers the actuation surface and in a second position protrudes from the container attachment, and a channel element which has a substantially cylindrical form, is rotatably mounted in the container attachment about its longitudinal axis and comprises a passage channel for a medium to be dispensed, the channel element being coupled to the cover element in such a manner that in a first position of the cover element the passage channel is rotated into a position connected to the discharge channel and in the second position of the cover element is rotated into a position blocking the discharge channel.

14 Claims, 5 Drawing Sheets

SPRAY HEAD FOR A CONTAINER WITH A VALVE

CROSS-REFERENCE TO RELATED APPLICATIONS

Not applicable.

STATEMENT REGARDING FEDERALLY SPONSORED RESEARCH

Not applicable.

BACKGROUND OF THE INVENTION

The present invention relates to a spray cap for discharging a fluid or a similar medium via a spray container.

Spray caps are sufficiently well known. They frequently comprise a container attachment, overlapping the mounting cup, which is placed on the container, for example a can. The container attachment generally comprises a displaceably mounted actuating element which transfers a force applied onto the valve via an extension pipe. By pressing on the actuating surface the latter is displaced into the container attachment and exerts a force on the valve via the extension pipe. The depressed valve opens and the contents of the container enters a discharge channel via the extension pipe from where it then discharges and is released into the surrounding area. After using the spray cap the latter is closed by a generally cylindrical overcap.

The object of the present invention is to provide a cap which by simple means prevents inadvertent actuation of the valve and simultaneously effectively closes a discharge aperture.

BRIEF SUMMARY OF THE INVENTION

The cap according to the invention comprises a container attachment, a cover element and a channel element. The container attachment comprises an actuating surface, an extension pipe for receiving the valve and a discharge channel connected to the extension pipe. The cover element is hinged on the container attachment and can be pivoted into a first and second position. In the first position the cover element covers the actuating surface at least partially, whilst in the second position the cover element protrudes from the container attachment.

The channel element has a substantially cylindrical form and is rotatably mounted in the container attachment about its cylinder longitudinal axis. Furthermore the channel element comprises a passage channel for the medium to be dispensed. The channel element is coupled to the cover element in such a manner that in the first position of the cover element the passage channel is rotated into a position connected to the discharge channel. In the second position of the cover element the passage channel is rotated into a position blocking the discharge channel. With the cap according to the invention the pivotable cover element has two functions: on the one hand the actuating element is protected from inadvertent actuation and thus secured, at the same time the discharge aperture is closed by rotating the channel element. In its open position the cover element uncovers the actuating surface and rotates the channel element into a position in which the passage channel forms an extension of the discharge channel and as a whole the medium to be dispensed reaches the discharge channel and the passage channel via the valve and the extension pipe.

A particular advantage of the cap according to the invention is that in the unused state, ie with the cover element closed, it is particularly well secured against an inadvertent discharge of the medium and for example can therefore be perfectly easily transported in luggage.

In a preferred embodiment the discharge channel is arranged transversely to the longitudinal direction of the extension pipe. The discharge channel thus extends radially outwards, when referring to a spray container with round cross section.

The cylindrical channel element comprises recesses on its ends and on the cover element corresponding projections which engage in the recesses to rotate the channel element together with the cover element. Via the engagement of the projections in the channel element the cover element is pivotally mounted relative to the container attachment.

The projections for fastening the cover element to the channel element preferably have a substantially rectangular form which in particular facilitates using the cover element.

The cover element has a substantially circular form with two heads protruding parallel to one another from which the projections for mounting the cover element to the channel element protrude. Of course the channel element can also be provided with projections and the ribs of the cover element with recesses.

The cover element comprises a semi-circular recess between the ribs.

The container attachment comprises an annular attachment region for connecting to the container. This connection takes place for example via a latching mechanism.

The container attachment further comprises a terminal region from which the extension pipe protrudes centrally into the container attachment. A portion of the terminal region comprising the actuating surface is not connected to the attachment region along an edge portion. The portion facing the actuating surface comprises a free edge portion which is pressed by pressing onto the actuating surface in the container attachment.

The attachment region comprises a cylindrical receiver for the channel element which extends transversely to the longitudinal axis of the container attachment. The receiver for the channel element is preferably arranged at a distance from the centre of the container attachment. The channel element is preferably peripherally arranged on the container attachment. The receiver for the channel element preferably protrudes partially from the terminal region, the protrusion relating to the axial direction of the container attachment. The discharge channel appropriately leads into the receiver, a discharge aperture being arranged for the passage channel in a straight extension of the discharge channel.

BRIEF DESCRIPTION OF THE SEVERAL VIEWS OF THE DRAWINGS

A preferred embodiment of the cap according to the invention will be described hereinafter in more detail with reference to the drawings, in which.

DETAILED DESCRIPTION OF THE INVENTION

Figure 1:
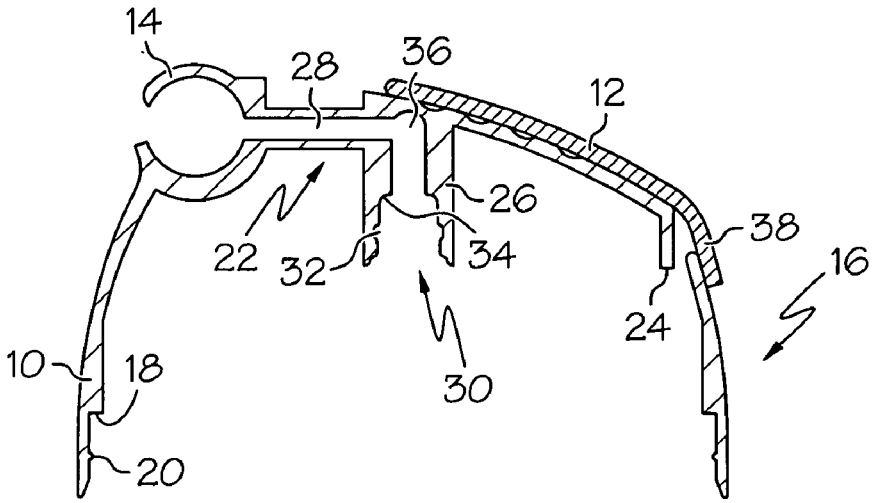
FIG. 1 is a cross section through the cap according to the invention.
Figure 2:
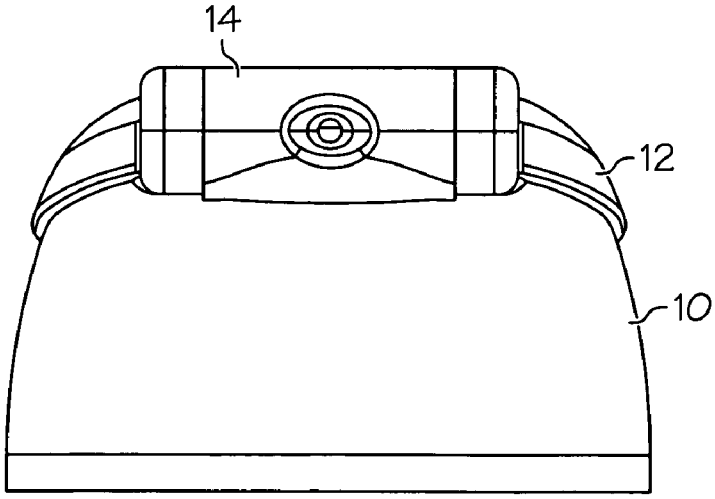
FIG. 2 is a front perspective view of the cap according to the invention.

While this invention may be embodied in many different forms, there are described in detail herein a specific preferred embodiment of the invention. This description is an exemplification of the principles of the invention and is not intended to limit the invention to the particular embodiment illustrated FIGS. 1 to 4 show the cap according to the invention with a container attachment 10, a cover element 12 and a receiver 14 for a channel element. The container attachment 10 comprises an annular attachment region 16 which on its inner face comprises a peripheral shoulder 18 Between the shoulder 18 and the free end of the attachment region 16 a plurality of latching lugs 20 are provided which can also be constructed as a peripheral ring. The internal diameter of the attachment region 16 corresponds to the internal diameter of the container. When in place the shoulder 18 is located on the upper edge of the container and the latching lugs 20 grip for example the valve mounting cup or the beaded edge of the can from behind.

The attachment region 16 is sealed by a terminal region 22 which, originating approximately near the discharge channel 14, extends as far as the edge 24. In the terminal region a hollow extension pipe 26 is located centrally which is connected to the discharge channel 28. The extension pipe 26 comprises a gradually enlarging receiver aperture 30 which comprises a peripheral recess 32 and a shoulder 34. In the assembled position the extension pipe 26 is placed on the valve stem which protrudes through the inlet aperture 30 and fits tightly on the shoulder 34. The medium to be dispensed is discharged from the valve stem into the discharge channel 28, which in the region 36 is angled at 90°. The angled region 36 comprises a convex recess to divert the flow of the medium to be discharged.

The receiver 14 for the channel element (see FIGS. 10 to 12) is attached as a cylindrical bead on the face of the container attachment 10. The cylindrical receiver is of open construction on the front faces of the cylinder. The discharge channel 28 leads centrally between the ends of the receiver 28 therein and points centrally to the centre line axis thereof.

The cover 12 is shown in FIG. 1 in its closed position and with one outer edge region 38 fits tightly onto the attachment ring 16.

Figure 3:
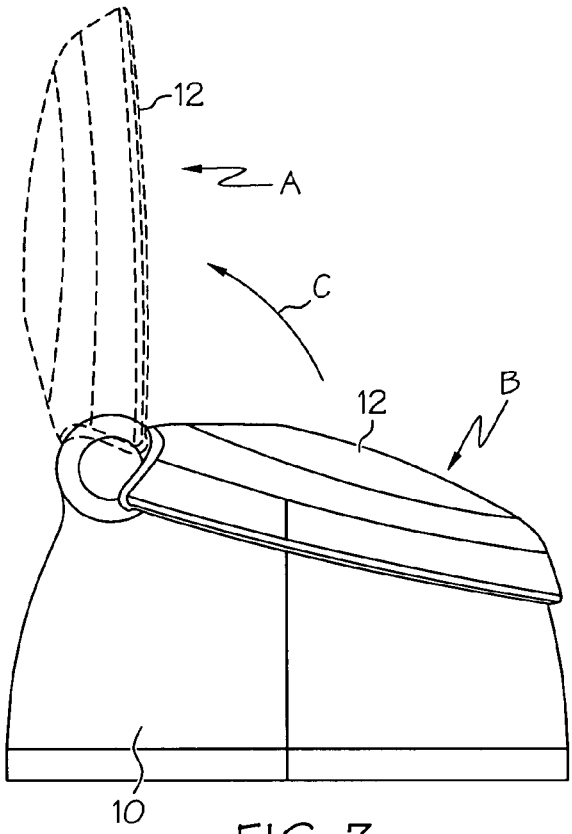
FIG. 3 is a side perspective view of the cap according to the invention.
Figure 4:
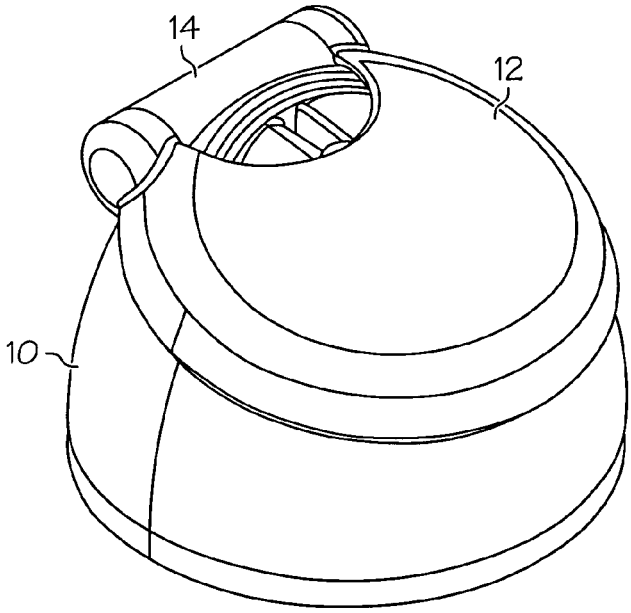
FIG. 4 is a three quarter perspective view of the cap according to the invention.

The opened position A of the cover element 12 is shown in FIG. 3 together with the closed position B of the cover element 12. The cover element 12 is moved from position B into position A by a pivoting movement to be able to actuate the spray cap.

Figure 5:
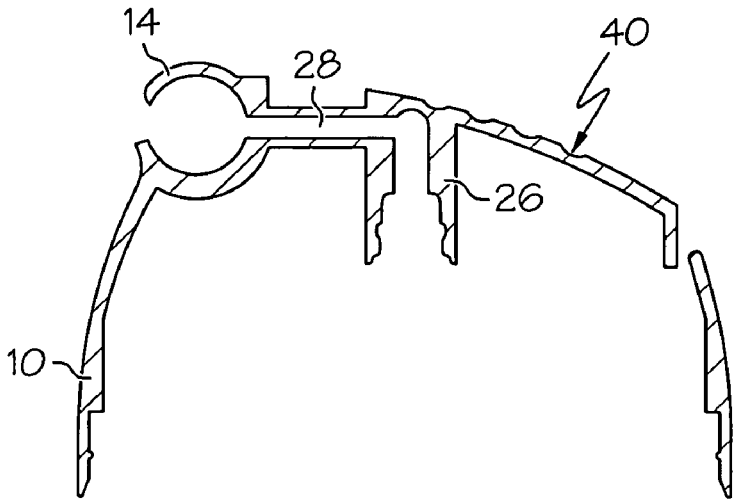
FIG. 5 is a cross section through the container attachment.
Figure 6:
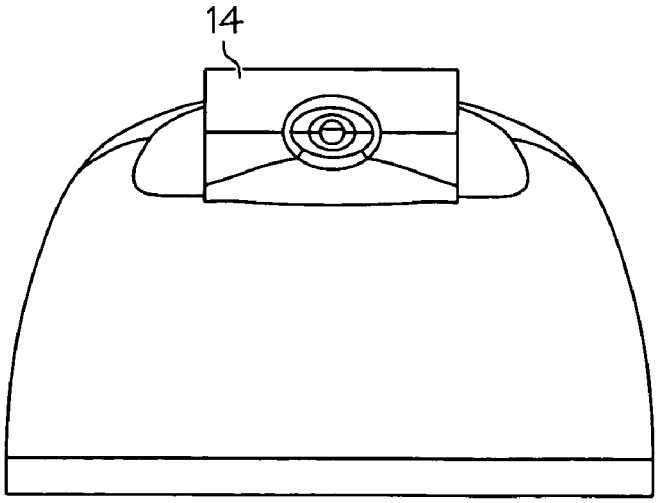
FIG. 6 is the container attachment in a front perspective view.
Figure 7:
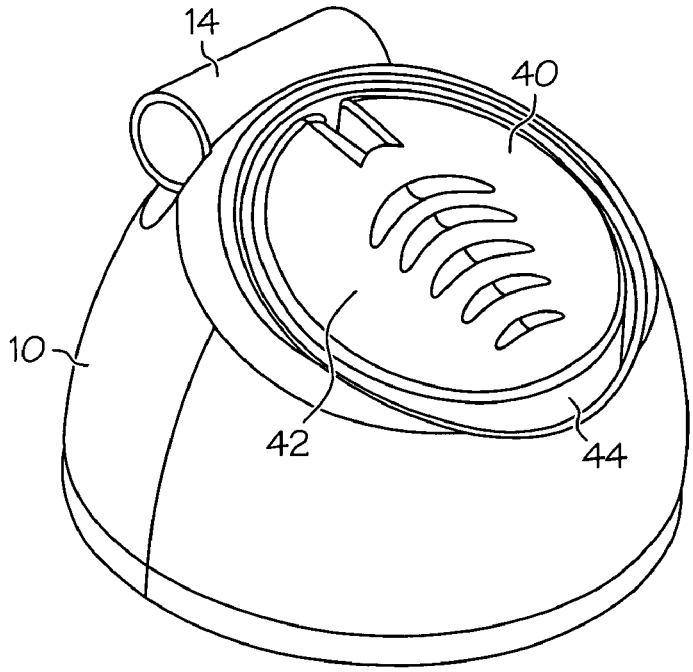
FIG. 7 is a three quarter perspective view of the container attachment.

FIGS. 5 to 7 show the container attachment without the cover element. The container attachment 10 comprises an actuating surface 40 which is arranged in a portion 42 (see FIG. 7). The portion 42 comprises an approximately round or slightly elliptical surface which is displaceably mounted in the container attachment 10. The connection takes place substantially in the region of the discharge channel 28 and the receiver 14 for the channel element. The actuating button 42 comprises an approximately round to slightly elliptical upper face which merges laterally with one edge 44.

Figure 8:
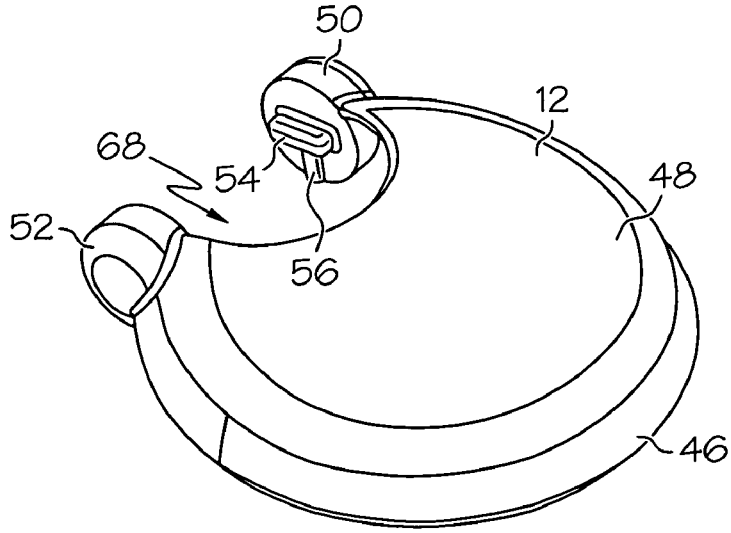
FIG. 8 is the cover element in a three quarter perspective view.
Figure 9:
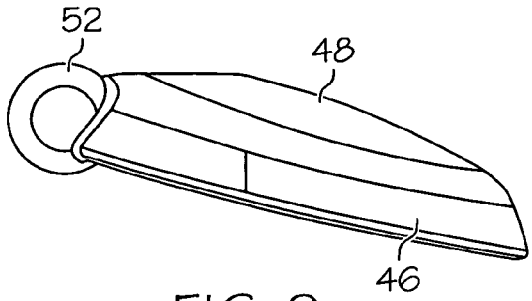
FIG. 9 is the cover element in side view.

FIGS. 8 and 9 show the cover element 12 according to the invention alone. The cover element 12 has a slightly domed upper face 48 which merges with a downwardly protruding edge 46. The cover element 12 has a slightly domed form with a substantially circular periphery. Connected to the cover element 12 are two cylindrical heads 50 and 5 which extend away from the cover element. The cylindrical heads 50 comprise a spacing which approximately corresponds to the width of the receiver 14. On their front faces facing one another the heads 50 and 52 comprise rectangular projections 54 (projection on head 52 not visible). The rectangular projections 54 have a slightly less prominent latching lug 56 which together with the projection 54 forms a T-shape.

Figure 10:
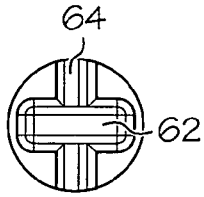
FIG. 10 is the channel element in side view.
Figure 11:
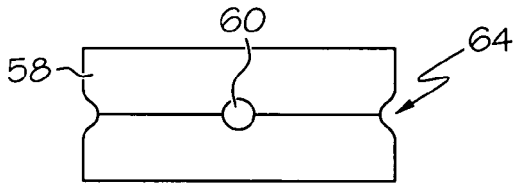
FIG. 11 is a front view of the channel element and FIG. 12 is a perspective view of the channel element.
Figure 12:
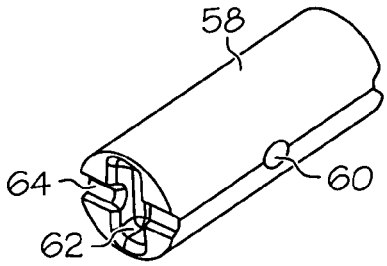

FIGS. 10 to 12 show the channel element 58 with the passage channel 60. The channel element 58 has a cylindrical shape and in its external diameter corresponds to the internal diameter of the receiver 14. Of course the channel element can also have any other form—which is rotatable in the receiver 14. On the front faces of the channel element 58 recesses 62 are provided which in their form correspond to the projection 54. In addition to the recess 62 a recess (64) is provided on the respective front faces which in its dimensions corresponds to the smaller latching lug 56. The channel element is either manufactured from hard plastics or a flexible plastics material, such as for example Santoprene, to improve the seal.

During assembly the channel element 58 is introduced into the receiver 14 of the container attachment 10. The cover element 12 is placed on the receiver 14, the projections 54 and 56 engaging in the recesses 62 and 64. The heads 50 and 52 are slightly separated when positioning the cover element which is made easier by the recess 66 in the cover element 12.

During operation the cover element 12 rotates the channel element 58 in the receiver 14. In position B shown in FIG. 3 the cover element is rotated in such a manner that the channel element 58 closes the discharge channel 8, the through channel being approximately perpendicular to the discharge channel. In position A in FIG. 3 the channel element 58 with its through channel 60 is arranged in precisely such a manner that the through channel 60 extends the discharge channel 28. The cover 12 is secured in the closed position by the recess 64 and the projection 56, whilst the projection 56 engages in the recess 64.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

What is claimed is:

1. A Cap for a container with a valve, with a container attachment (10) which comprises an actuation surface (40), an extension pipe (26) for receiving the valve and a discharge channel (28) connected to the extension pipe (26), a cover element (12) which is pivotally mounted relative to the container attachment (10), in a first position (B) at least partially covers the actuation surface (40) and in a second position (A) protrudes from the container attachment (10), and a channel element (58) which has a substantially cylindrical form is rotatably mounted in the container attachment about its longitudinal axis and comprises a passage channel (60) for a medium to be dispensed, the channel element (58) being coupled to the cover element (12), in such a manner that in a first position (B) of the cover element (12) the passage channel (60) is rotated into a position connected to the discharge channel (28) and in the second position (A) of the cover element (12) the passage channel (60) is rotated into a position blocking the discharge channel (28).

2. The Cap according to claim 1, wherein the discharge channel (28) extends through the channel element (58) transversely to the longitudinal axis of the extension pipe (28).

3. The Cap according to claim 1, wherein the channel element (58) comprises recesses (62) on its ends and the cover element comprises projections (54) which engage in the recesses (62) to rotate the channel element (58) together with the cover element (12).

4. The Cap according to claim 3, wherein the recesses (62) and the projections (54) have a substantially rectangular form.

5. The Cap according to claim 3, characterised in that the cover element (12) has a substantially circular form with two heads (50, 52) protruding parallel to one another, from which respectively a projection (54) protrudes.

6. The Cap according to claim 5, characterised in that the cover element (12) has a semi-circular recess (66) between the heads.

7. Cap according to claim 1, characterised in that the container attachment (10) comprises an annular attachment region (16) for connecting to the container.

8. The Cap according to claim 7, characterised in that the container attachment (10) comprises a terminal region (22) from where the extension pipe (26) protrudes centrally into the container attachment (10).

9. The Cap according to claim 8, characterised in that a portion (42) comprising the actuating surface (40) is not connected to the container attachment along an edge portion (44).

10. The Cap according to claim 8, characterised in that the terminal region (22) has a receiver (14) for the channel element (58) which extends transversely to the longitudinal axis.

11. The Cap according to claim 10, characterised in that the receiver (14) for the channel element (58) is at a distance from the centre of the container attachment (10).

12. The Cap according to claim 10, characterised in that the receiver (14) partially protrudes from the terminal region (22).

13. The Cap according to claim 10, characterised in that the discharge channel (28) leads into the receiver (14).

14. The Cap according to claim 13, characterised in that the receiver comprises a discharge aperture for the medium in the straight extension of the discharge channel (28).

* * * * *